United States Patent [19]

Kessler

[11] 4,116,426

[45] Sep. 26, 1978

[54] CUTTING BOARD

[76] Inventor: Milton Kessler, 6690 Harrington Ave., Youngstown, Ohio 44512

[21] Appl. No.: 773,285

[22] Filed: Mar. 1, 1977

[51] Int. Cl.[2] ..... B23Q 3/00
[52] U.S. Cl. ..... 269/307
[58] Field of Search ..... 269/307, 302.1, 289–296; 83/522, 565

[56] References Cited

U.S. PATENT DOCUMENTS

| | | | |
|---|---|---|---|
| 734,663 | 7/1903 | Bower | 269/307 |
| 797,644 | 8/1905 | Trahern | 269/302.1 |
| 2,115,507 | 4/1938 | Glidden | 269/296 |
| 3,548,519 | 12/1970 | Oliver | 83/522 |

FOREIGN PATENT DOCUMENTS

| | | | |
|---|---|---|---|
| 188 of | 1905 | United Kingdom | 269/302.1 |

*Primary Examiner*—Robert C. Watson
*Attorney, Agent, or Firm*—David A. Burge Co.

[57] ABSTRACT

A transparent cutting board formed from plastics material has an embossed cutting surface on which mat boards and the like may be supported for trimming. A design is printed on a smooth back surface of the cutting board and includes intersecting guidelines and indicia which are viewable through the cutting surface to facilitate the trimming of mat boards and the like. The embossed cutting surface is defined by a multiplicity of spaced, upstanding, integrally formed projections. The projections resist marring while providing a relieved cutting surface across which cutting tools can be moved swiftly and easily.

5 Claims, 5 Drawing Figures

CUTTING BOARD

BACKGROUND OF THE INVENTION

1. Field of the Invention

The present invention relates generally to cutting boards formed from transparent plastics material, and more particularly to a novel and improved transparent cutting board having an embossed cutting surface and a smooth back surface bearing a printed design which is viewable through the cutting surface to facilitate trimming operations.

2. Prior Art

Cutting boards are known which have smooth cutting surfaces provided with decorative and/or functional printed designs. A problem with cutting boards having smooth cutting surfaces is that they do nothing to camouflage scratches formed as cutting tools move across their cutting surfaces. Still another problem is that the continuous and smooth nature of their cutting surfaces provides a constant, noticeable drag or resistance to the movement of cutting tools across their cutting surfaces.

Cutting boards which have roughened cutting surfaces are also known. Roughened cutting surfaces have the advantage of camouflaging scratches and nicks, whereby the boards retain a good appearance through prolonged use. Still another advantage stemming from the use of roughened cutting surfaces is that the relieved character of the surfaces poses lesser resistance to the movement of cutting tools. If 20 or 30 percent of the cutting surface along a path of tool movement is kept out of contact with a cutting tool by virtue of the relieved character of a cutting surface, it follows that the surface will impose a correspondingly lesser drag or resistance to tool movement.

A problem with cutting boards having roughened cutting surfaces is that they are not easily provided with decorative and/or functional designs of the type which can facilitate trimming operations. Attempts made to provide such design elements as guidelines and indicia on roughened cutting surfaces result in wavy, distorted design elements which have less than the desired pleasing appearance and which are difficult to use as trimming guides.

Cutting boards formed from transparent plastics material having roughened cutting surfaces have been proposed for home use. To the best of applicant's knowledge, none of these boards have been provided with functional designs which are viewable through their roughened cutting surfaces to facilitate cutting operations.

In the framing of photographic prints, diplomas, and the like, it is customary to trim a mat board to provide an outer, rectangular shape with dimensions appropriate for use with a preformed picture frame, and to provide a rectangular hole in central portions of the mat board with dimensions suitable to border selected parts of a photograph or diploma. The trimming operations required to form these mat boards are commonly conducted on an opaque cutting board having a substantially smooth cutting surface. Design elements such as guidelines and indicia are provided on the cutting surface itself to facilitate trimming operations. Cutting boards of this type are usually formed from wood and may have their design elements burned into or otherwise recessed in the cutting surface to preserve their integrity during prolonged use. These cutting boards are relatively expensive, heavy, and awkward to store. Their cutting surfaces have the previously described drawbacks of resisting cutting tool movement and readily displaying scratches and nicks formed as cutting tools move over their cutting surfaces.

SUMMARY OF THE INVENTION

The present invention overcomes the foregoing and other drawbacks of prior proposals by providing novel and improved, lightweight and inexpensive, transparent plastic cutting boards having embossed cutting surfaces through which such design elements as guidelines and indicia can be viewed to facilitate cutting and trimming operations.

In accordance with the preferred practice of the present invention, a transparent cutting board is formed from plastics material and is provided with an embossed cutting surface overlying a smooth, planar back surface. The interrupted character of the embossed surface permits cutting tools to be moved smoothly and easily across it. The surface tends to camouflage the presence of nicks and scratches, and thereby retains a good appearance during prolonged use.

A design including such functional elements as a grid of perpendicularly intersecting guidelines and line identification indicia is printed on the back surface and is viewable through the embossed cutting surface. The design elements are protected from exposure to cutting tools by virtue of their location on the back surface, and yet are readily visible as assists to determine the locations and orientations of cutting lines.

In preferred practice, the embossed cutting surface is formed in such a way that a major portion of its surface area is defined by relatively flat surface portions which extend in planes substantially paralleling the plane of the back surface. This arrangement permits the design elements printed on the back surface to be viewed through the embossed cutting surface with minimal optical distortion. The embossed cutting surface is preferably defined by a multiplicity of spaced, upstanding projections. The projections extend upwardly from a substantially flat lower surface portion, and have substantially flat tops defining upper surface portions. The upper and lower surface portions parallel the plane of the back surface and facilitate viewing the printed design through the cutting surface with minimal optical distortion.

In preferred practice, the upstanding projections are of random shape and vary in size to prevent the introduction of such distortions and discontinuities as arise where designs are viewed through ordered arrays of uniformly sized projections. The projections have substantially vertical wall portions interconnecting the upper and lower planar surface portions. While some optical distortion of a design is inherent where the design is viewed through anything other than a perfectly flat surface, it has been found that the distortion level is quite acceptably low where projections of the described type are provided.

The projections preferably have flat top surface portions which vary in size from about 0.0001 square inch in area to about 0.003 square inch in area. The spacing between adjacent projections preferably varies from between about 0.002 inch to about 0.04 inch. The projections preferably measure about 0.003 inches in height, their height being defined by the distance between the planar lower and upper surface portions of the cutting surface. There are preferably about 190 projections per square inch of cutting surface area.

By controlling the size, number and spacings of the projections, one can enhance or minimize a slight sawing action induced in cutting tool movements by the rough character of the embossed cutting surface. A sawing action is desirable for some types of cutting and trimming operations, and detracts from the desired cutting action in other types of operations. A feature of the present invention is that it permits cutting board surfaces to be custom designed to provide desired types of cutting tool movement for particular purposes.

Still another feature which obtains from the use of discrete projections extending upwardly from a flat, lower surface portion is that the projections shield the lower surface portion from scratches and nicks, thereby preserving its optical integrity to facilitate distortion-free viewing of design elements printed on the back surface of the cutting board.

It is a general object of the present invention to provide novel and improved cutting boards. Other objects and a fuller understanding of the invention may be had by referring to the following description and claims taken in conjunction with the accompanying drawing.

DESCRIPTION OF THE PREFERRED EMBODIMENT

Figure 1:
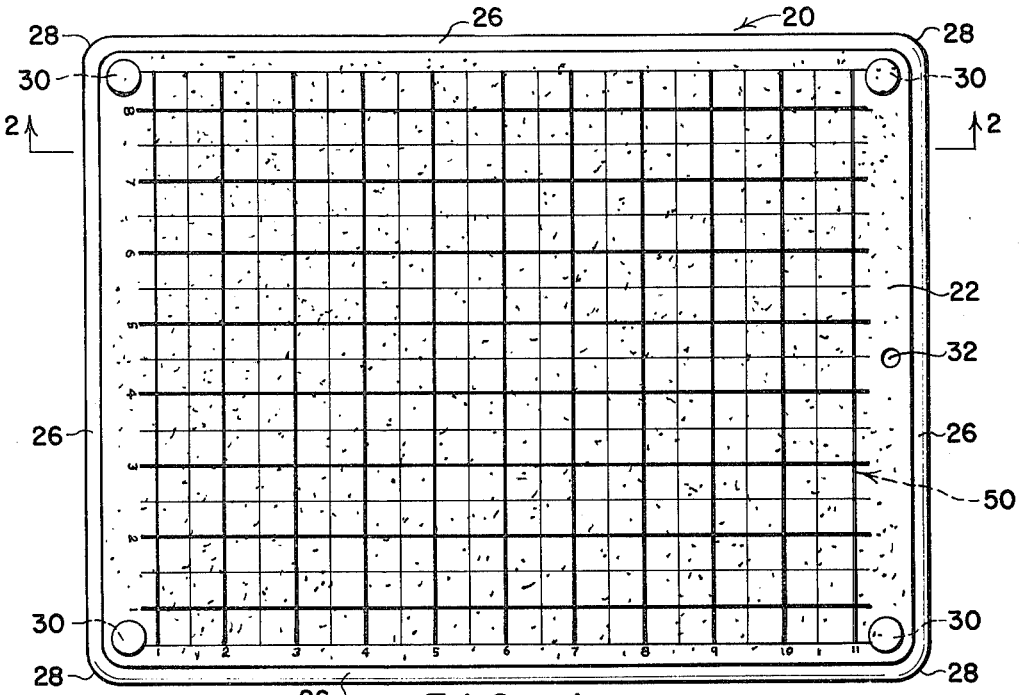
FIG. 1 is a top plan view of a cutting board embodying the preferred practice of the present invention.
Figure 2:
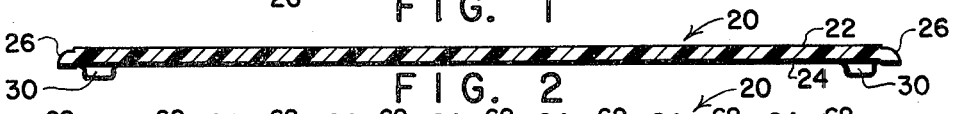
FIG. 2 is a sectional view as seen from a plane indicated by a line 2—2 in FIG. 1.
Figure 3:
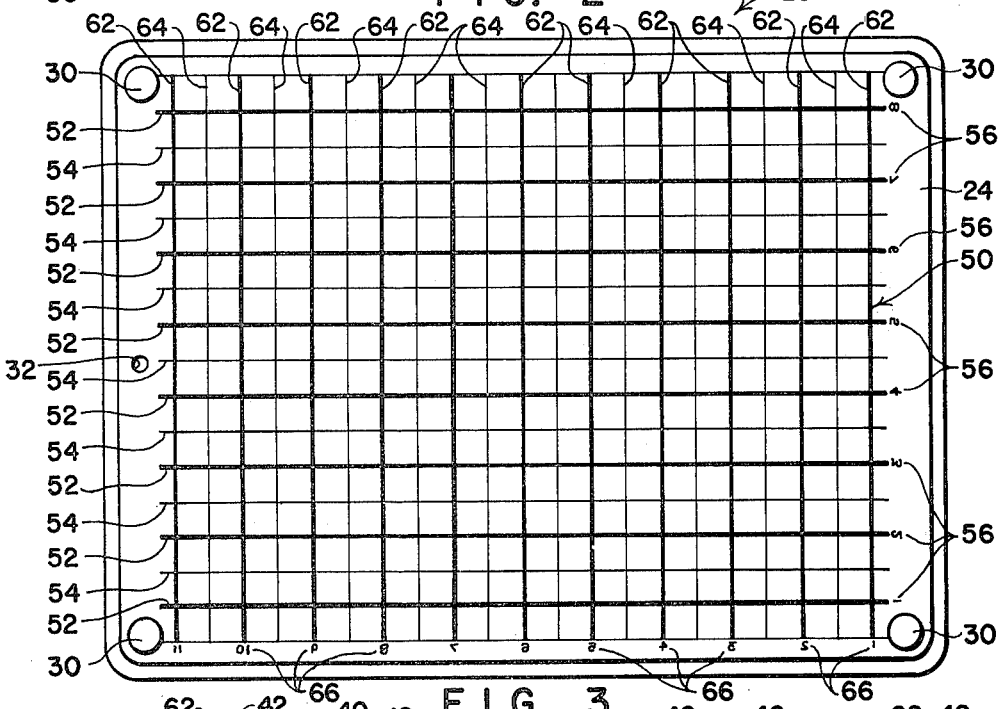
FIG. 3 is a bottom plan view of the cutting board of FIG. 1.

Referring to FIGS. 1-3, a cutting board embodying the preferred practice of the present invention is indicated generally by the numeral 20. The cutting board 20 is formed from transparent plastics material, preferably an acrylic plastic or polystyrene. The cutting board 20 has an embossed cutting surface 22 formed on its upper side, and a smooth back surface 24 formed on its lower side. A design, indicated generally by the numeral 50, is printed on the back surface 24 and is viewable through the cutting surface 22.

The cutting board 20 is shown as having a generally rectangular shape, but can, of course, be square or assume other configurations appropriate for its intended use. The board 20 has rounded edges 26 which intersect to form rounded corners 28. Rubber feet 30 are adhered to the back surface 24 near the corners 28 to support the body of the cutting board 20 in an elevated attitude above a work surface. A hole 32 is formed through the cutting board 20 near one of the edge formations 26 to facilitate storing the cutting board 20 by hanging it from a suitable hook.

Figure 4:
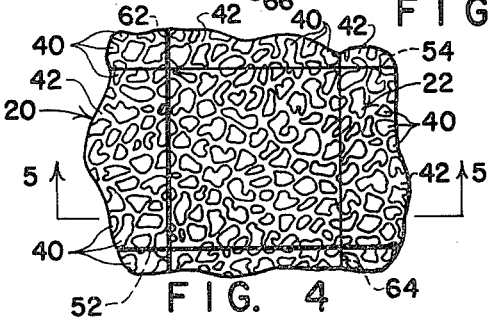
FIG. 4 is an enlarged top plan view of a portion of the cutting board of FIG. 1; and, FIG. 5 is an enlarged sectional view of a portion of the cutting board as seen from a plane indicated by a line 5—5 in FIG. 4.
Figure 5:
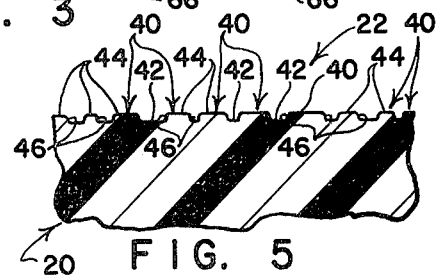

Referring to FIGS. 4 and 5, the preferred embodiment of the embossed cutting surface 22 includes a multiplicity of spaced, upstanding projections 40. The projections 40 extend upwardly from a substantially flat, lower surface portion 42, and have substantially flat tops which extend in a common plane defined upper surface portions 44. The lower and upper surface portions 42, 44 extend in planes which parallel the plane of the back surface 24. The projections 40 have sidewalls 46 which extend substantially vertically between the lower and upper surface portions 42, 44. By this arrangement, what one sees when viewing the cutting board 20 from above are substantially flat surface portions 42, 44 through which the design 50 can be viewed with minimal optical distortion.

The projections 40 are best described as having a random shape, when viewed from above. Their flat top surface portions 44 vary in size from about 0.0001 square inch in area to about 0.003 square inch in area. The spacing between the projections varies from about 0.002 inch to about 0.04 inch. The distance between the planes of the lower and upper surface portions 42, 44, i.e., the height of the projections 40, is about 0.003 inch. Thus the spacing distance between projections is close to the same order of magnitude as the surface dimensions of the projections. There are about 190 projections per square inch of cutting surface area. This described arrangement of projections is found to be suitable for most cutting and trimming operations.

The average spacing between adjacent projections, their height, and/or the number of projections per unit of area can be adjusted to enhance or minimize the presence of a slight sawing action character in cutting tool movements. Where relatively thick stock is being cut, an up-down sawing action character is often desirable in cutting tool movements. Thinner, more delicate stock is often best trimmed by a relatively smooth tool movement. Cutting boards custom designed for particular cutting and trimming operations can therefore be provided by controlling the number, size, and spacing of the projections 40.

The design 50 can be applied to the smooth back surface 24 by any of a variety of simple techniques such as silk screening, hot stamping, decal imprinting and the like. Referring to FIGS. 1 and 3, the depicted design 50 includes a plurality of intersecting guidelines 52, 54, 62, 64, and two sets of numerical indicia 56, 66. The indicia 56, 66 may represent any suitable units of distance such as inches. The guidelines 52, 62 are shown as being heavier in character than the guidelines 54, 64, whereby the guidelines 52, 62 may represent the bounds of a single dimensional unit while the guidelines 54, 64 may indicate fractional unit portions. Other decorative and/or functional design arrangements will be apparent to those skilled in the art.

As will be apparent from the foregoing description, the present invention provides cutting boards which are well adapted for use in trimming mat boards for framing photographs, diplomas and the like. They are light in weight, inexpensive to fabricate, and easy to store. By providing the cutting surface 22 with an embossed character, it resists and conceals scratches and nicks and promotes easy tool movement with a desired cutting action. The flat surface portions 42, 44, make up the majority of the cutting surface 22, as seen when the board 20 is viewed from above, and permit the design 50 to be viewed with minimal optical distortion. The projections 40 themselves shield the lower surface portions 42 from contact with cutting tools and thereby maintain the optical integrity of this substantial portion of the cutting surface through prolonged use.

Although the invention has been described in its preferred form with a certain degree of particularity, it is understood that the present disclosure of the preferred form has been made only by way of example and numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A cutting board, consisting of:

(a) a sheet of transparent plastics material having a top surface and an underlying bottom surface;

(b) the top surface including an embossed cutting surface portion extending over the majority of the area of the top surface and being defined by a multiplicity of spaced projections which extend upwardly from a lower, substantially planar surface segment and which have substantially flat tops defining upper surface segments, the lower and upper surface segments extending in planes substantially paralleling the plane of the underlying bottom surface, the space projections being separated one from another by the order of magnitude of the surface dimensions of the projections;

(c) the bottom surface including a smooth, planar back surface portion extending over the majority of the area of the bottom surface and underlying the embossed cutting surface portion;

(d) design means including a grid of intersecting guidelines formed directly on the back surface portion and being viewable through the embossed cutting surface portion to facilitate the trimming of articles supported on the embossed cutting surface portion;

(e) the design means additionally including indicia means adjacent selected ones of the guidelines for facilitating reference to the selected guidelines during the trimming of articles supported on the embossed cutting, surface portion; and, (f) whereby the cutting surface portion has a major portion of its surface area defined by substantially flat surface segments extending in planes substantially paralleling the plane of the back surface portion thereby permitting the design on the back surface portion to be viewable through the cutting surface portion with minimal optical distortion.

2. The cutting board of claim 1 wherein the projections have substantially vertically extending sidewalls interconnecting the lower and upper surface segments.

3. The cutting board of claim 2 wherein the upper surface segments extend in a substantially common plane spaced from the plane of the lower surface segment by about 0.003 inch.

4. The cutting board of claim 3 wherein the projections have a substantially random shape when viewed from above, have top surface portions which vary in area from between about 0.0001 square inch to about 0.003 square inch, and are spaced one from another by distances which vary from about 0.002 inch to about 0.04 inch.

5. The cutting board of claim 4 wherein the projections number about 190 per square inch of area of the cutting surface portion.

* * * * *